US008978436B2

(12) United States Patent
McRae et al.

(10) Patent No.: US 8,978,436 B2
(45) Date of Patent: Mar. 17, 2015

(54) ROLLING MILL TEMPERATURE CONTROL

(75) Inventors: Alan Douglas McRae, Dorset (GB); Paul Ronald Osborne, Dorset (GB); Peter Derrick Smith, Dorset (GB)

(73) Assignee: Siemens PLC, Surrey (GB)

( * ) Notice: Subject to any disclaimer, the term of this patent is extended or adjusted under 35 U.S.C. 154(b) by 857 days.

(21) Appl. No.: 13/140,864

(22) PCT Filed: Nov. 23, 2009

(86) PCT No.: PCT/GB2009/051590
§ 371 (c)(1),
(2), (4) Date: Sep. 6, 2011

(87) PCT Pub. No.: WO2010/070310
PCT Pub. Date: Jun. 24, 2010

(65) Prior Publication Data

US 2011/0308288 A1 Dec. 22, 2011

(30) Foreign Application Priority Data

Dec. 19, 2008 (GB) ..... 0823227.4

(51) Int. Cl.
*B21B 27/06* (2006.01)
*B21B 28/00* (2006.01)
*B21B 27/10* (2006.01)
*B21B 3/00* (2006.01)
(Continued)

(52) U.S. Cl.
CPC . *B21B 27/10* (2013.01); *B21B 3/00* (2013.01); *B21B 37/32* (2013.01); *B21B 9/00* (2013.01); *B21B 15/005* (2013.01); *B21B 27/106* (2013.01); *B21B 37/74* (2013.01); *B21B 38/00* (2013.01); *B21B 38/02* (2013.01); *B21B 2003/001* (2013.01); *B21B 2027/103* (2013.01)
USPC ..... 72/201; 72/236

(58) Field of Classification Search
USPC ..... 72/201, 236
See application file for complete search history.

(56) References Cited

U.S. PATENT DOCUMENTS 6,874,344 B1 4/2005 Junius et al. ..... 72/38
7,181,822 B2 2/2007 Ondrovic et al. ..... 29/527.7
(Continued)

FOREIGN PATENT DOCUMENTS

CN 101128271 A 2/2008 ..... B21B 27/10
DE 3150996 C1 3/1983 ..... B21B 45/02
(Continued)

OTHER PUBLICATIONS

International PCT Search Report, PCT/GB2009/051590, 14 pages, May 12, 2010.
(Continued)

*Primary Examiner* — Teresa M Ekiert
(74) *Attorney, Agent, or Firm* — King & Spalding L.L.P.

(57) ABSTRACT

For controlling the flatness of the strip during the rolling of aluminum strip or foil, the system consists of a full width bank of cryogenic roll cooling devices acting on the roll(s) and a full width bank of roll heating devices also acting the roll(s). Both or either of the cooling and heating banks are divided into individually controllable zones. A process automation system controls the action of the cooling and heating banks via feedback from a strip shape meter and/or a predictive process model, in order, by thermal growth/contraction, to create the best roll profile for rolling flat strip.

29 Claims, 3 Drawing Sheets

(51) Int. Cl.

| | |
|---|---|
| ***B21B 37/32*** | (2006.01) |
| *B21B 9/00* | (2006.01) |
| *B21B 15/00* | (2006.01) |
| *B21B 37/74* | (2006.01) |
| *B21B 38/00* | (2006.01) |
| *B21B 38/02* | (2006.01) |

(56) References Cited

U.S. PATENT DOCUMENTS

| | | | | |
|---|---|---|---|---|
| 7,963,136 | B2 * | 6/2011 | Flick et al. | 72/11.7 |
| 2007/0084263 | A1 * | 4/2007 | Zurecki | 72/342.3 |
| 2007/0175255 | A1 | 8/2007 | Pawelski et al. | 72/201 |
| 2009/0282884 | A1 * | 11/2009 | Pawelski et al. | 72/201 |

FOREIGN PATENT DOCUMENTS

| | | | | |
|---|---|---|---|---|
| DE | 102005001806 | A1 | 7/2006 | B21B 45/02 |
| EP | 0041863 | A2 | 12/1981 | B05B 1/30 |
| GB | 2012198 | A | 7/1979 | B21B 37/28 |
| JP | 60238012 | A | 11/1985 | B21B 1/22 |
| JP | 09239402 | A | 9/1997 | B21B 1/22 |
| JP | 2001096301 | A | 4/2001 | B21B 27/10 |
| JP | 2004050192 | A | 2/2004 | B21B 27/10 |
| JP | 2004066310 | A | 3/2004 | B21B 27/10 |
| JP | 2007203317 | A | 8/2007 | B21B 27/10 |
| RU | 910267 | | 3/1982 | B21B 45/02 |
| SU | 994068 | A1 | 2/1983 | B21B 37/32 |
| SU | 1796308 | A1 | 2/1993 | B21B 1/32 |
| WO | 02/087803 | A1 | 11/2002 | B21B 1/22 |
| WO | 2005/094280 | A2 | 10/2005 | |
| WO | 2006/074875 | A1 | 7/2006 | B21B 27/10 |
| WO | 2010/070310 | A1 | 6/2010 | B21B 27/10 |

OTHER PUBLICATIONS

European Search Report, GB0823227.4, 1 page, Dec. 30, 2008.
Chinese Office Action, Application No. 200980151052.6, 13 pages, Apr. 3, 2014.
Japanese Office Action, Application No. 2011-541586, 5 pages, Apr. 22, 2014.

* cited by examiner

ROLLING MILL TEMPERATURE CONTROL

CROSS-REFERENCE TO RELATED APPLICATIONS

This application is a U.S. National Stage Application of International Application No. PCT/GB2009/051590 filed Nov. 23, 2009, which designates the United States of America, and claims priority to GB Application No. 0823227.4 filed Dec. 19, 2008. The contents of which are hereby incorporated by reference in their entirety.

TECHNICAL FIELD

The invention relates to the field of aluminium strip or foil rolling mills and describes a new process which will improve the temperature control of the mill rolls, in order to improve strip flatness and give other safety and production benefits.

BACKGROUND

The process of rolling aluminium requires lubrication in order to gain a satisfactory surface finish of the strip at higher reductions. However, even with lubrication, the rolling process generates a large amount of heat, which must be dissipated to prevent equipment overheating and the breakdown of the lubricant. Therefore additional cooling of the rolls is required. At present this has only been achieved in two ways:

A small number of mills rolling cold aluminium strip or foil use water based emulsions as the rolling coolant and lubricant. This would seem to be an ideal solution as water has a high cooling capacity, whilst the oil content can be tuned to give good lubrication properties. However, unless the water is completely removed from the strip immediately after rolling, stains are created on the strip surface, spoiling its appearance. In practise, it has been very difficult to ensure completely dry strip unless the strip exit temperature from the mill is considerably greater than 100° C. This limits the practicality of rolling and hence just a few specialist mills rolling specific products use this method.

The vast majority of mills rolling cold aluminium strip or foil use kerosene as both rolling lubricant and coolant. Kerosene was found to have the best compromise between cooling and lubricating properties without having any strip marking issues. However, kerosene is not the best lubricant or coolant and has significant fire safety, environmental and health problems associated with it.

In order to provide effective cooling with kerosene, flow rates of up to several thousand liters per minute may be required. Such volumes require expensive recirculation and filtration systems and will inevitably cause oil mist to form which requires expensive fume extraction and cleaning systems. The inventors have shown that for the purpose of lubrication alone, flow rates of less that 10 liter/minute can suffice.

In both the above solutions, banks of spray nozzles apply the fluid directly to the rolls in order to effectively cool them, whilst further separately controlled spray nozzles direct fluid on to the rolls nearer to the roll nip in order to lubricate the rolling process.

A further use for the cooling sprays is also known. One of the main challenges in the cold rolling of aluminium strip and foil is to ensure that the product is flat after rolling. Bad flatness is caused by the strip being reduced in thickness by different amounts across the width of the mill. This is caused by variations in the gap between the rolls across the mill. By varying the cooling effect across the roll's width, it is possible to impart different degrees of thermal expansion to different parts of the roll, thereby providing a mechanism to compensate for local variations in roll gap.

A number of patents (e.g. GB2012198, EP41863) exist illustrating the technology for varying the cooling rate across the width of the roll and, with the use of a flatness measuring device on the exit side of the mill, directly controlling the flatness of the rolled strip.

GB2156255 describes a process which employs separate lubrication and cooling (SLC). Banks of water jets are used to cool the rolls and effect shape control, whilst low quantities of more suitable lubricating oil are applied directly to the strip upstream of the mill.

The effect known in the aluminium industry as "tight edge" is one of the main causes of strip breaks during rolling. GB2080719 describes partial roll heating using the so called "Tight Edge inductors" (TEIs)—This technology uses the induction effect to locally heat up the mill rolls in the area of the strip edge in order prevent the under rolling of the strip edges.

This technology has been used successfully on a number of mills, however, there are significant challenges with using electrical heating devices on a mill using kerosene coolant.

In their paper "Thermal Shape Control in Cold Strip Rolling by Controlled Inductive Roll Heating", International Conference of Steel Rolling, Japan, 1980, Sparthmann & Pawelsky, describe experiments done using a combination of water cooling jets and induction heaters to effect flatness changes during the rolling of steel strip.

Further developments in this field up to the present day have been limited to improvements in the control and resolution of the kerosene cooling effect.

Meanwhile, in other fields some work had been done in using cryogenic gases or liquids as a coolant in industrial rolling processes. Various patents have been published on this topic including DE3150996, JP2001096301, WO02/087803, U.S. Pat. No. 6,874,344.

However, all this prior work has concentrated on cooling the processed material for metallurgical and other effects.

US 2007/0175255 discloses a method and apparatus for cold rolling of a metallic rolling stock in which a number of nozzles are used to apply various combinations of lubricant emulstion or base oil, coolant and inert gas are applied to the wedge and arc areas of upper and lower rolls, for the purpose of cleaning, cooling, lubrication and rendering inert. Flatness control of a thermal working roll barrel is alluded to, however, it is described as being achieved by using a combination of inert gas and conventional coolants, which in the field of aluminium rolling implies a high kerosene flow rate with all its associated equipment and safety issues.

SUMMARY

According to an embodiment, an apparatus for rolling a metal foil or strip may comprise a pair of working rolls arranged to receive the strip in a nip region therebetween; a plurality of cryogenic fluid applicators arranged to direct a cryogenic fluid to one or more of a plurality of zones on the surface of at least one of the rolls and means for heating one or more of the plurality of zones on the surface of the roll via one or more heating devices According to a further embodiment, an apparatus may further comprise a flatness measuring device arranged to provide a signal indicative of flatness of the metal strip after it passes from the roll. According to a further embodiment, an apparatus may further comprise means for varying the application of heat and, or cryogenic fluid to the one or more zones, responsive to said signal. According to a further embodiment, an apparatus may further comprise a processor arranged to receive data from the flatness measuring device and to control the heating devices and, or the cryogenic fluid applicators responsive to the data, thereby varying the application of heat and, or cryogenic fluid to the one or more zones. According to a further embodiment, the flatness measuring device can be arranged to measure the profile of the roll. According to a further embodiment, the flatness measuring device can be arranged directly to measure the flatness of the metal strip. According to a further embodiment, an apparatus may further comprise a lubricant supply and means for directing the lubricant to the strip, upstream of the rolls.

According to a further embodiment, lubricant supply can be arranged to direct lubricant at less that 10 liter/minute. According to a further embodiment, the plurality of cryogenic fluid applicators can be arranged to direct the cryogenic fluid to one or more of a plurality of zones in the arc region of at least one of the rolls. According to a further embodiment, an apparatus may further comprise at least one barrier arranged to prevent intrusion by the cryogenic fluid to the wedge region of the roll and, or the strip. According to a further embodiment, the barrier may comprise a solid barrier. According to a further embodiment, the barrier may comprise a gas curtain. According to a further embodiment, an apparatus may further comprise an inner compartment enclosing the rolls; an outer compartment enclosing the inner compartment; means for maintaining the inner compartment at a positive pressure relative to ambient pressure and means for maintaining the outer compartment at a negative pressure relative to ambient pressure. According to a further embodiment, an apparatus may further comprise dry gas injection means. According to a further embodiment, an apparatus may further comprise gas extraction means. According to a further embodiment, the cryogenic fluid may comprise nitrogen. According to a further embodiment, the cryogenic fluid may comprise carbon dioxide.

According to another embodiment, a method of controlling the shape of a metal strip or foil during rolling, may comprise directing a cryogenic fluid to one or more of a plurality of zones on the surface of one or more rolls via one or more cryogenic fluid applicators, the plurality of zones being evenly distributed across the width of the roll and heating one or more of the plurality of zones on the surface of the roll via one or more heating devices, thereby controlling the radial size of the roll across the roll's width.

According to a further embodiment of the method, an apparatus may further comprise the steps of: arranging a flatness measuring device to provide a signal indicative of flatness of the metal strip after it passes from the roll; receiving data from the flatness measuring device and varying the application of cryogenic fluid and, or heat to the one or more zones, responsive to said data. According to a further embodiment of the method, application of cryogenic fluid and, or heat to the one or more zones can be manually varied by a human operator, responsive to said data. According to a further embodiment of the method, application of cryogenic fluid and, or heat to the one or more zones can be varied by a processor, arranged to receive data from the flatness measuring device and control the one or more cryogenic fluid applicators and, or the one or more heating devices. According to a further embodiment of the method, the flatness measuring device can be arranged to measure the profile of the roll. According to a further embodiment of the method, the flatness measuring device can be arranged directly to measure the flatness of the strip. According to a further embodiment of the method, the method may further comprise applying a lubricant to the strip, upstream of the roll. According to a further embodiment of the method, the lubricant can be applied at a rate of less than 10 liter/minute. According to a further embodiment of the method, the cryogenic fluid can be directed to the arc region of at least one roll, and further comprising the step of providing a barrier to cryogenic fluid intruding on the wedge region and, or the strip.

According to a further embodiment of the method, the barrier can be a solid barrier. According to a further embodiment of the method, the barrier can be a gas curtain. According to a further embodiment of the method, the method may further comprise the steps of: enclosing the rolls in an inner compartment; enclosing the inner compartment in an outer compartment; maintaining a positive pressure in the inner compartment, relative to ambient pressure and maintaining a negative pressure in the outer compartment, relative to ambient pressure. According to a further embodiment of the method, the pressure of the inner compartment can be controlled by dry gas injection means and, or gas extraction means. According to a further embodiment of the method, the pressure of the outer compartment can be controlled by gas extraction means. According to a further embodiment of the method, the control of said compartment pressures can be controlled manually as an open loop system. According to a further embodiment of the method, the control of said compartment pressures can be controlled automatically using pressure sensing means in conjunction with a computer control system. According to a further embodiment of the method, the cryogenic fluid directed to one or more of a plurality of zones on the surface of one or more rolls may comprise nitrogen. According to a further embodiment of the method, the cryogenic fluid directed to one or more of a plurality of zones on the surface of one or more rolls may comprise carbon dioxide.

BRIEF DESCRIPTION OF THE DRAWINGS

The invention will now be described, by non-limiting example, with reference to FIGS. 1, 2, & 3 in which.

DETAILED DESCRIPTION

Figure 1:
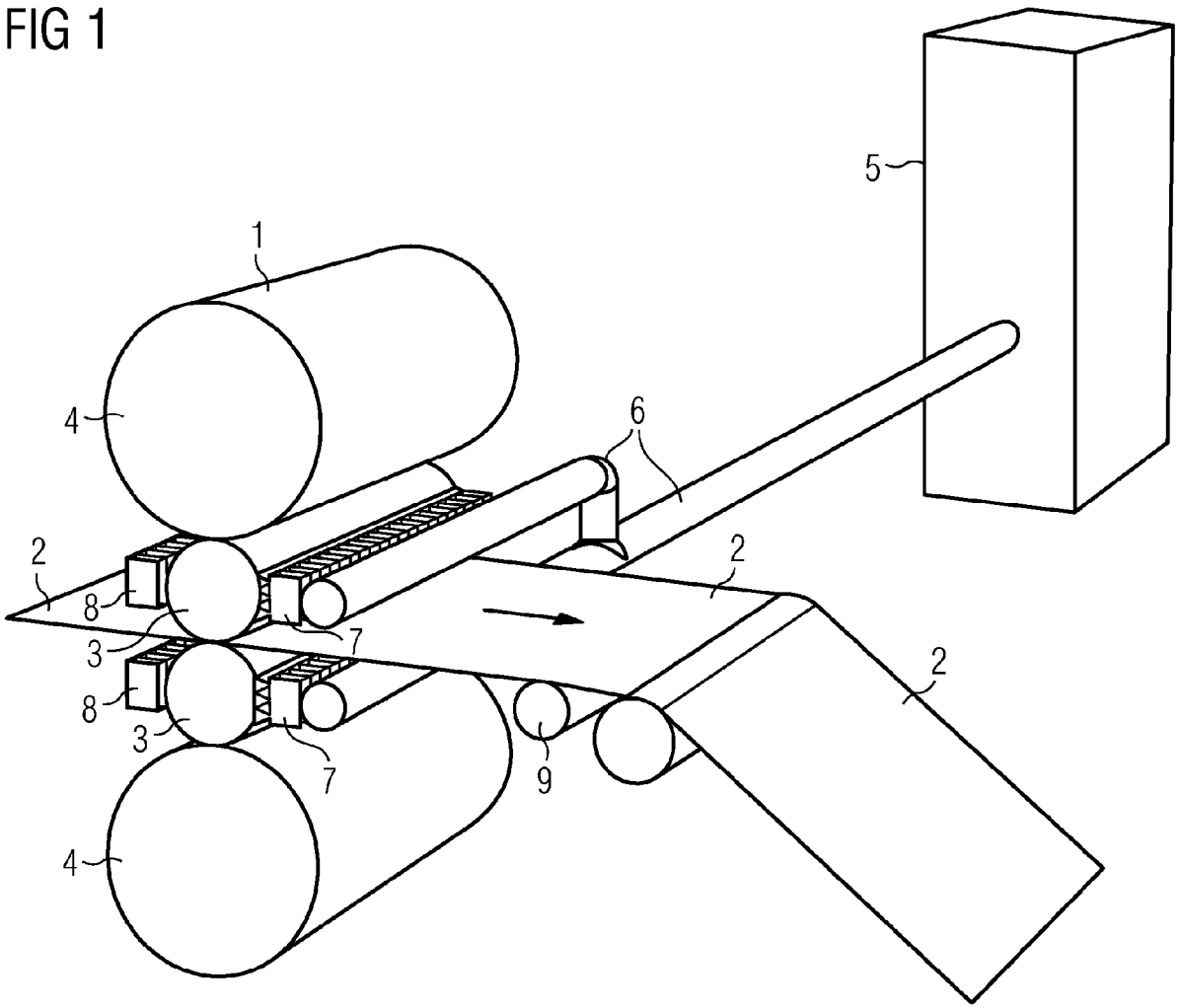
FIG. 1 shows a perspective sketch of a rolling mill according to various embodiments.

In the context of this specification, the term cryogen refers to a substance which is normally gaseous at room temperature but which is maintained in liquid state by suitable control of temperature and pressure and which is used as a coolant. Related terms such as cryogenic should be construed accordingly.

Cryogen includes, but is not limited to nitrogen, carbon dioxide, argon and oxygen.

Embodiments offer a new improved cooling and flatness control technology to be conceived with the following features:

- Banks of cryogenic gas or liquid applicators apply cooling to either or both sides of the mill rolls
- These applicators are divided into individually controllable zones which can be controlled to give a varying cooling effect across the width of the roll
- Additionally, one or more full width roll heating devices are used in conjunction with the roll coolant applicators.
- The roll heating devices are split into a number of individually controllable zones across the width of the roll. The number of zones may or may not be the same as the number of cooling zones depending on process requirements.

A flatness control system in conjunction with a flatness measuring device mounted on the exit side of the mill varies the amount of cooling or heating applied to each zone of roll width in order to produce flat strip. In its simplest form, the flatness control system is realised by a human operator who varies the amount of heating and, or cooling responsive to data provided by the flatness measuring device. In a more sophisticated embodiment, an electronic controller is provided and arranged to vary the heating and, or cooling responsive to such data.

Insulated and protected cryogenic feed lines connect the storage tanks to the application headers In order to prevent condensation of water vapour due to cold temperatures the mill stand may be provided with a double staged containment and ventilation system. The inner compartment containing the mill stand is kept at a positive pressure to ensure no ingress of water vapour into the chilled regions, whilst the outer regions are kept at a negative pressure compared to the main plant in order to prevent oxygen depletion in personnel access areas.

Separate rolling lubricant is applied to the strip prior to rolling. This is applied in a very thin even layer using a process such as electrostatic deposition.

This system offers numerous and large benefits over the prior art:

The complete replacement of kerosene as a roll coolant with a cryogenically cooled inert liquid or gas completely removes the risk of fires on the mill. At once removing a large safety, and production loss risk, whilst removing the need to install expensive fire prevention equipment.

Reduced environmental impact of the aluminium rolling process. Release of hydrocarbons into the atmosphere is reduced to zero once kerosene is removed from the process.

Introduction of full width zoned roll cooling and heating enables the flatness control system to react quicker to process changes than a cooling only system. It also enables easy roll temperature management situations such as width changes or cold starts where all or part of the roll needs to be heated and other parts need to be cooled.

The outer zones of the heating devices will also provide effective reduction of the "tight edge" flatness defect Application of very small amounts of alternative rolling oil directly to the strip prior to rolling will lead to the following benefits over existing systems:

- Optimisation of oil properties for lubrication of rolling only, allowing larger reductions to be taken for a given set of mill parameters compared to kerosene rolling—this leads to higher production
- Reduced incidences of coil staining during annealing caused by excess lubricant left on the strip after rolling—this leads to higher product yield
- Reduced incidences of coil staining due to contamination of coolant by oil leaks—this leads to higher product yield
- Reduced time for coil annealing due to reduced requirement to evaporate excess kerosene Additionally, the replacement of kerosene with a cryogenic coolant removes the requirement for the following pieces of equipment and their associated operating costs:

- Kerosene storage tanks and circulation systems
- Kerosene fume treatment plant
- Kerosene filtration plant
- Mill exit strip blow off equipment Removal of the kerosene filtration plant removes the requirement for the use and subsequent costly disposal of hazardous filtration media, leading to a safety and cost benefit.

Mill civil works are substantially simplified as the need for specially protected oil flumes and storage cellars are removed.

Space requirements for mill as a whole are reduced with the removal of the large kerosene handling systems.

FIG. 1 shows a schematic diagram of a rolling mill stand 1 according to various embodiments with aluminium strip or foil 2 passing through the stand from left to right as arrowed. The mill work rolls 3 and back up rolls 4 are loaded and rotated in order to perform the reduction in thickness of the metal as is widely known in the art. Before entering the area shown in the diagram, the metal to be rolled 2 has a suitable rolling lubricant applied to it in a very thin uniform layer. According to various embodiments, a lubricant flow rate of less than 10 l/minute is typically sufficient.

The local temperature (and therefore diameter) of the work rolls 3 is controlled during the rolling process as follows:

A cryogenic storage and delivery system 5 supplies cryogenic coolant to coolant applicators 7 via insulated and protected feed pipes 6. In this embodiment, the cryogenic coolant applicators 7 are located on the exit side of the mill, however, they could be located anywhere around the work roll 3 diameter as dictated by mill size, available space and cooling effect required.

The cryogenic coolant applicators 7 are divided into individually controllable zones in order to apply different cooling effects across the width of the rolls as required by the strip flatness control system.

In addition to the cryogenic coolant applicators 7, full width heating devices 8 are shown on the entry side of the mill. These heating devices 8 may be located anywhere around the work roll periphery as dictated by the mill size, available space and heating effect required.

The heating devices 8 are divided into individually controllable zones in order to apply varying heating effects across the width of the rolls as required by the strip flatness control system.

A flatness measuring device 9, known as a "shape meter" in the art, is used to provide feedback signals relating to the flatness of the strip produced by the mill. These signals are used by the flatness control system. Any signal indicative of the flatness of the strip can serve as a feedback upon which the control system bases adjustments of the heating devices and, or cryogenic applicators. For example, since flatness of the strip is a function of the profile of the roll, using the shape meter to measure the latter provides a signal indicative of the strip flatness, albeit indirectly (the term "profile of the roll" is intended to mean uniformity of roll diameter across its width). However, in the embodiment illustrated, the shape meter 9 is used to measure strip flatness directly.

An electronic computer based flatness control system (not illustrated) is used to ensure the metal processed is as flat as possible. The electronic control system uses the feed back signals from the shape meter plus the other rolling parameters as inputs to a computer based flatness model. The model then calculates the correct actions to be taken to ensure flat strip. These actions are transmitted as electronic signals to the cryogenic coolant applicators, full width heating devices, and the conventional mechanical flatness actuators provided as part of the rolling mill stand (for example, roll bending cylinders).

Flatness control systems for use in conjunction with kerosene based cooling are known in the art and, in light of this knowledge, a skilled person is well able to provide a system suitable for use with a cryogenic coolant.

The unique full width dual cooling and heating system enables greater flexibility of control and faster temperature change response times.

Figure 2:
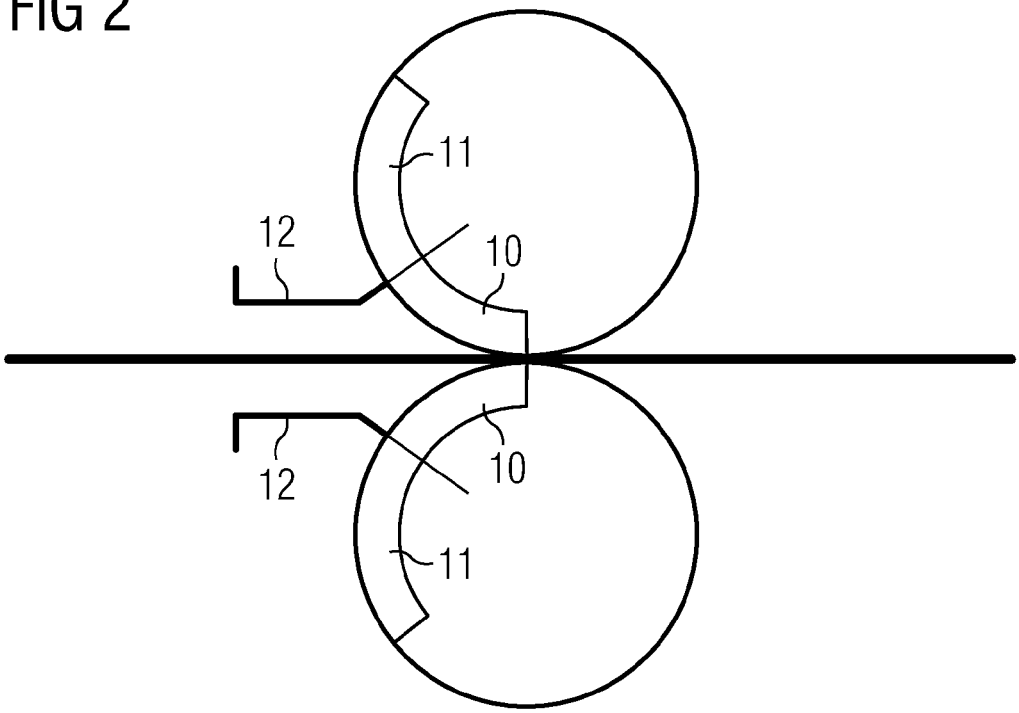
FIG. 2 is a detail view showing an additional feature according to various embodiments.

Referring to FIG. 2, the inventors have found that for the purpose of flatness control, application of coolant to the 'wedge' area 10 of the roll is undesireable for at least two reasons, namely:

1) this gives rise to an ill defined and uneven spray area which makes flatness control more difficult and 2) some of the coolant inevitably contacts the strip itself and uncontrolled cooling of the strip on either side of the roll can give rise to flatness errors.

For these reasons, according to an embodiment, the cryogenic coolant is directed to the 'arc' area 11 of the roll and a barrier 12 is included to prevent coolant reaching the wedge area and the strip.

Figure 3:
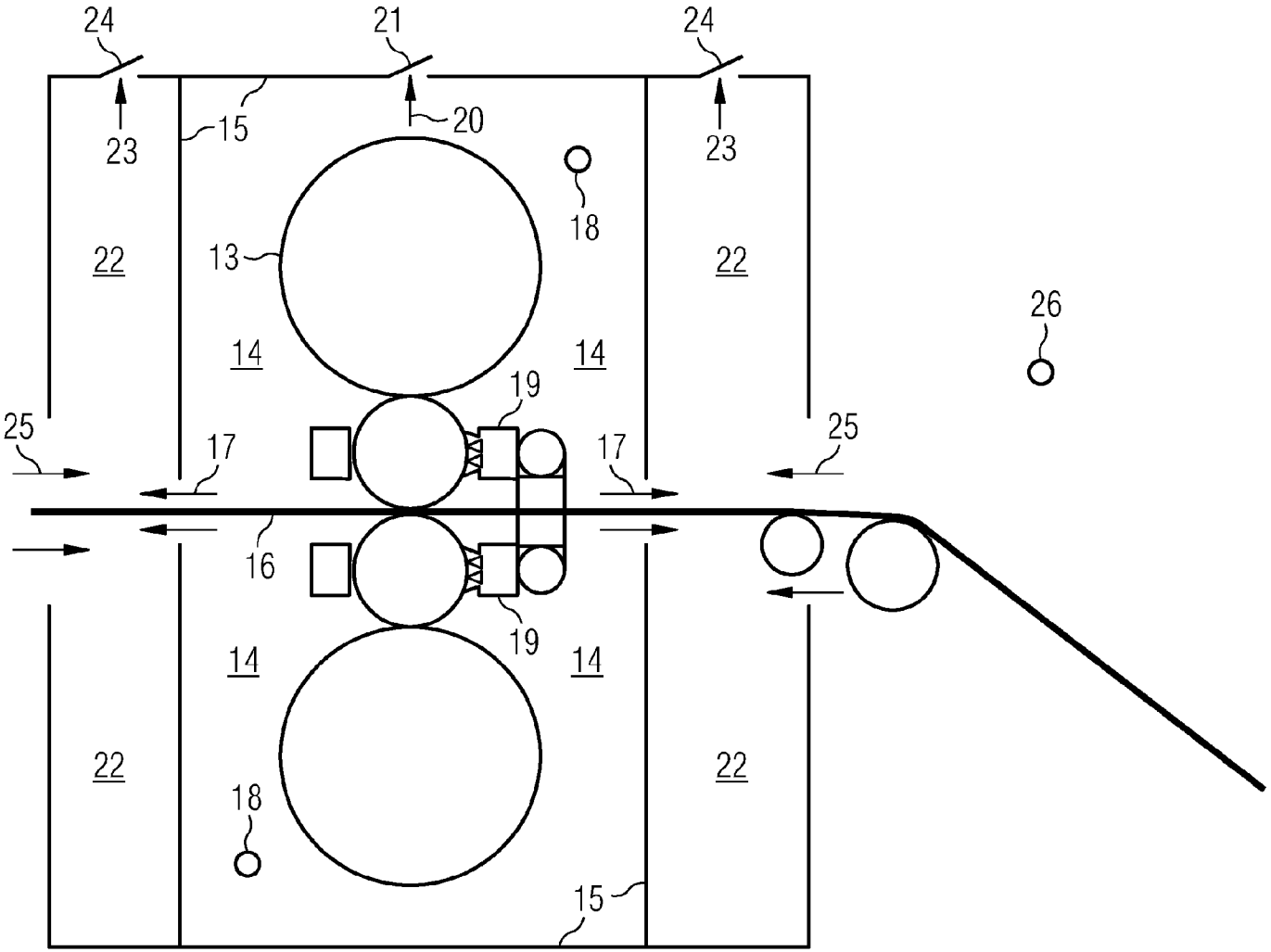
FIG. 3 is a schematic illustration illustrating a further feature according to various embodiments.

Barrier 12 is illustrated schematically in FIG. 3. In practice, the barrier 12 could be realised as (for example) a gas curtain, a solid barrier or a combination of both.

In order to realise the effectiveness of the above system, it is preferrable that the cryogenic equipment used does not cause water to condense on the mill equipment and drip on to the strip. FIG. 3 shows a method of excluding water vapour from the mill stand area and hence preventing any condensation.

The mill stand equipment 13 is surrounded by an inner chamber 14. The chamber is created by sheet material 15 and will include closable access points and removable sections as required to allow maintenance access to the mill stand equipment 13. The metal to be processed 16 by the mill will pass through openings on either side of the inner chamber 14. The inner chamber 14 is not a sealed unit, but the sheet material 15 reduces the remaining openings 17 to a size where the pressure within the chamber can be controlled.

Before the start of rolling (for example after a maintenance activity) a suitable amount of dry gas is introduced into the inner chamber in order to force out any water vapour that may be present before the cryogenic coolant applicators 19 are activated. The dry gas is introduced at one or more points 18 within the inner chamber 14.

One or more gas extraction points 20 are provided for the inner chamber. These extraction points are connected to a separate gas extraction system as is well known in the art. A valve or damper 21 is present at each extraction point 20 to control the amount of extraction which occurs.

During rolling, the cryogenic coolant used to cool the mill rolls produces a pressure of dry gas within the inner chamber 14. The dry gas feed points 18 or the dampers 21 as appropriate are used to ensure that a small positive pressure of dry gas is maintained within the inner chamber 14. This control may be affected manually or automatically using a suitable pressure sensor. The small positive pressure will prevent any ingress of water vapour but will also cause an amount of dry gas to constantly escape from the inner chamber through the gaps represented by 17.

In order to prevent a build up of gas reducing oxygen levels in operator access areas around the mill stand, an outer chamber 22 surrounds the inner chamber. The outer chamber is of similar sheet material construction as the inner chamber. Similarly, to the inner chamber, the outer chamber is not fully sealed, but openings are reduced in size sufficiently for some pressure control to be possible.

Extraction points 23 connected to the same gas extraction system as the inner chamber are provided. Valves or dampers 24 control the extraction rate to ensure that the outer chamber is always held at a negative pressure compared to the operator areas and hence ambient air will be sucked in through the openings 25 in the outer chamber 22. By this method, minimal gas is emitted from the outer chamber, ensuring the safety of the mill operators.

The correct functioning of the extraction system is verified by appropriately positioned oxygen depletion detectors 26.

The invention claimed is:

1. An apparatus for rolling a metal strip comprising:

a pair of working rolls configured to receive the metal strip in a nip region there between;

a plurality of cryogenic fluid applicators configured to direct a cryogenic fluid to one or more first zones on the surface of at least one of the working rolls, each first zone comprising an arc region of a respective working roll, one or more heating devices configured to heat one or more second zones on the surface of the working roll, and at least one cryogenic fluid barrier, wherein each cryogenic fluid barrier is:

arranged between (a) a point of contact between a respective working roll and the metal strip and (b) the arc region of the respective roll to which the cryogenic fluid is directed, and configured to prevent intrusion of the cryogenic fluid to at least one of (a) a wedge region of the respective roll defined between the cryogenic fluid barrier and a point of contact between the respective working roll and the metal strip and (b) the metal strip; and wherein each cryogenic fluid barrier comprises a gas curtain.

2. The apparatus according to claim 1, further comprising a flatness measuring device configured to provide a signal indicative of flatness of the metal strip after it passes from the working rolls.

3. The apparatus according to claim 2, further comprising a controller configured to vary at least one of the application of the cryogenic fluid to the one or more first zones and the application of heat to the one or more second zones based on said signal.

4. The apparatus according to claim 3, comprising a processor configured to receive data from the flatness measuring device and to control at least one of the heating devices and the cryogenic fluid applicators based on the data, thereby varying at least one of the application of heat to the one or more second zones and cryogenic fluid to the one or more first zones.

5. The apparatus according to claim 2, wherein the flatness measuring device is configured to measure a profile of the working roll.

6. The apparatus according to claim 2, wherein the flatness measuring device is configured to measure the flatness of the metal strip.

7. The apparatus according to claim 1, wherein the apparatus is configured to direct a lubricant to the metal strip, upstream of the working rolls.

8. The apparatus according to claim 7, wherein the apparatus is configured to direct lubricant at less than 10 liter/minute.

9. The apparatus according to claim 1, wherein the cryogenic fluid comprises nitrogen.

10. The apparatus according to claim 1, wherein the cryogenic fluid comprises carbon dioxide.

11. An apparatus for rolling a metal strip comprising:

a pair of working rolls configured to receive the metal strip in a nip region there between;

a plurality of cryogenic fluid applicators configured to direct a cryogenic fluid to one or more first zones on the surface of at least one of the working rolls, each first zone comprising an arc region of a respective working roll, one or more heating devices configured to heat one or more second zones on the surface of the working roll, at least one cryogenic fluid barrier, wherein each cryogenic fluid barrier is:

arranged between (a) a point of contact between a respective working roll and the metal strip and (b) the arc region of the respective roll to which the cryogenic fluid is directed, and configured to prevent intrusion of the cryogenic fluid to at least one of (a) a wedge region of the respective roll defined between the cryogenic fluid barrier and a point of contact between the respective working roll and the metal strip and (b) the metal strip;

an inner compartment enclosing the working rolls;

an outer compartment enclosing the inner compartment;

wherein the inner compartment is maintained at a positive pressure relative to ambient pressure, and wherein the outer compartment is maintained at a negative pressure relative to ambient pressure.

12. The apparatus according to claim 11, further comprising dry gas feed points or dampers configured to maintain the inner compartment at the positive pressure.

13. The apparatus according to claim 12, further comprising gas extraction valves or dampers configured to maintain the inner compartment at the negative pressure.

14. A method of controlling the shape of a metal strip during rolling, said method comprising:

directing a cryogenic fluid to one or more first zones on the surface of one or more rolls via one or more cryogenic fluid applicators, each first zone comprising an arc region of a respective roll, heating one or more second zones on the surface of the roll via one or more heating devices, thereby controlling the radial size of the roll across the roll's width, and using at least one cryogenic fluid barrier to prevent intrusion of the cryogenic fluid to at least one of (a) a wedge region of a respective roll defined between the cryogenic fluid barrier and a point of contact between the respective working roll and the metal strip and (b) the metal strip, wherein each cryogenic fluid barrier is arranged on a respective working roll between (a) the point of contact between the respective working roll and the metal strip and (b) the arc region of the respective roll to which the cryogenic fluid is directed, a flatness measuring device providing a signal indicative of flatness of the metal strip after it passes from the one or more rolls;

receiving data from the flatness measuring device, varying at least one of the application of cryogenic fluid to the one or more first zones and the application of heat to the one or more second zones based on said data, and measuring a profile of the roll by the flatness measuring device.

15. The method according to claim 14, comprising manually varying the application of at least one of the cryogenic fluid and heat to the one or more first or second zones based on said data.

16. The method according to claim 14, comprising automatically varying the application of cryogenic fluid or heat to the one or more first or second zones by a processor configured to receive data from the flatness measuring device and control at least one of the one or more cryogenic fluid applicators and the one or more heating devices.

17. The method according to claim 14, further comprising directly measuring the flatness of the metal strip by the flatness measuring device.

18. The method according to claim 14, further comprising applying a lubricant to the metal strip, upstream of the roll.

19. The method according to claim 18, where the lubricant is applied at a rate of less than 10 liter/minute.

20. The method according to claim 14, where each cryogenic fluid barrier is a solid barrier.

21. The method according to claim 14, wherein the cryogenic fluid directed to the one or more first zones on the surface of one or more rolls comprises nitrogen.

22. The method according to claim 14, wherein the cryogenic fluid directed to the one or more first zones on the surface of one or more rolls comprises carbon dioxide.

23. A method of controlling the shape of a metal strip during rolling, said method comprising:

directing a cryogenic fluid to one or more first zones on the surface of one or more rolls via one or more cryogenic fluid applicators, each first zone comprising an arc region of a respective roll, heating one or more second zones on the surface of the roll via one or more heating devices, thereby controlling the radial size of the roll across the roll's width, and using at least one cryogenic fluid barrier to prevent intrusion of the cryogenic fluid to at least one of (a) a wedge region of a respective roll defined between the cryogenic fluid barrier and a point of contact between the respective working roll and the metal strip and (b) the metal strip, wherein each cryogenic fluid barrier is arranged on a respective working roll between (a) the point of contact between the respective working roll and the metal strip and (b) the arc region of the respective roll to which the cryogenic fluid is directed, wherein each cryogenic fluid barrier is a gas curtain.

24. A method of controlling the shape of a metal strip during rolling, said method comprising:

directing a cryogenic fluid to one or more first zones on the surface of one or more rolls via one or more cryogenic fluid applicators, each first zone comprising an arc region of a respective roll, heating one or more second zones on the surface of the roll via one or more heating devices, thereby controlling the radial size of the roll across the roll's width, and using at least one cryogenic fluid barrier to prevent intrusion of the cryogenic fluid to at least one of (a) a wedge region of a respective roll defined between the cryogenic fluid barrier and a point of contact between the respective working roll and the metal strip and (b) the metal strip, wherein each cryogenic fluid barrier is arranged on a respective working roll between (a) the point of contact between the respective working roll and the metal strip and (b) the arc region of the respective roll to which the cryogenic fluid is directed, and further comprising the steps of:

enclosing the rolls in an inner compartment;

enclosing the inner compartment in an outer compartment;

maintaining a positive pressure in the inner compartment, relative to ambient pressure, and maintaining a negative pressure in the outer compartment, relative to ambient pressure.

25. The method according to claim 24, comprising controlling the pressure of the inner compartment using at least one of dry gas feed points and dampers.

26. The method according to claim 25, comprising controlling the pressure of the outer compartment using gas extraction valves or dampers.

27. The method according to claim 25, comprising manually controlling at least one of the positive pressure in the inner compartment and the negative pressure in the outer compartment as an open loop system.

28. The method according to claim 25, comprising automatically controlling at least one of the positive pressure in the inner compartment and the negative pressure in the outer compartment using pressure sensors in conjunction with a computer control system.

29. An apparatus for rolling a metal strip comprising:

a pair of working rolls configured to receive the metal strip in a nip region there between;

a plurality of cryogenic fluid applicators configured to direct a cryogenic fluid to one or more first zones on the surface of at least one of the working rolls, each first zone comprising an arc region of a respective working roll, one or more heating devices configured to heat one or more second zones on the surface of the working roll, and a flatness measuring device configured to measure a profile of at least one of the working rolls after the metal strip passes from the working rolls, the measured profile being indicative of a flatness of the metal strip.

* * * * *